US006232883B1

(12) United States Patent
Silva et al.

(10) Patent No.: US 6,232,883 B1
(45) Date of Patent: May 15, 2001

(54) WATER ALERT SYSTEM

(75) Inventors: Kevin DeVere Silva; Steven Dale McQueary, both of Indianapolis, IN (US)

(73) Assignee: Uncle Albert's LLC, Indianapolis, IN (US)

( * ) Notice: Subject to any disclaimer, the term of this patent is extended or adjusted under 35 U.S.C. 154(b) by 0 days.

(21) Appl. No.: 09/533,273

(22) Filed: Mar. 20, 2000

Related U.S. Application Data

(63) Continuation of application No. 09/193,334, filed on Nov. 16, 1998, now abandoned.

(51) Int. Cl.[7] ..... G08B 21/00

(52) U.S. Cl. ..... 340/604; 340/605; 340/618; 340/620; 340/539; 340/825.69; 340/825.72

(58) Field of Search ..... 340/604, 605, 340/618, 620, 539, 825.69, 825.72

(56) References Cited

U.S. PATENT DOCUMENTS

| | | | |
|---|---|---|---|
| 3,810,146 | 5/1974 | Lieb | 314/839 |
| 4,079,364 | 3/1978 | Antenore | 340/279 |
| 4,264,901 | 4/1981 | Petersen et al. | 340/604 |
| 4,714,914 | 12/1987 | Boe | 340/573 |
| 4,777,478 | 10/1988 | Hirsch et al. | 340/573 |
| 5,025,247 | 6/1991 | Banks | 340/573 |
| 5,311,100 * | 5/1994 | Brain | 315/129 |
| 5,710,989 * | 1/1998 | Flood | 345/100 |

* cited by examiner

*Primary Examiner*—Julie Lieu
(74) *Attorney, Agent, or Firm*—Woodard, Emhardt, Naughton, Moriarty & McNett

(57) ABSTRACT

A water activated power supply for signaling a control device of a detection of a body of water or other ionized liquid, and for triggering a bistate device upon the detection of a body of water or other ionized liquid. The water activated power supply comprises a power source, and a buffering circuit. The power source is operable to generate a first electrical power. The buffering circuit includes a buffer operable to provide a second electrical power. The buffering circuit further includes a water activated switch to conduct a portion of the first electrical power to the buffer when a body of water contacts the water activated switch. The buffer provides the second electrical power in response to the portion of the first electrical power. The buffer further isolates the power source from any external load device, e.g. a control device or a bistate device, electrically coupled to the buffering circuit to receive the second electrical power to prevent any increase in the magnitude of the first electrical power. Receipt of the second electrical power by an external load device indicates the detection of the body of water by the buffering circuit.

8 Claims, 8 Drawing Sheets

WATER ALERT SYSTEM

REFERENCE TO RELATED APPLICATIONS

Benefit is claimed under 35 U.S.C. §120 based upon continuation of U. S. patent application Ser. No. 09/193,334, filed Nov. 16, 1998 now abandoned.

BACKGROUND OF THE INVENTION

1. Field of the Invention

The present invention relates to the field of water alert systems. More particularly, the present invention relates to a water activated power supply for signaling a control device of the detected presence of a body of water, and for triggering a bistate device upon the detection of a body of water.

2. Background

Water alert devices including a power source and a water activated switching circuit for triggering a bistate device, e.g. a horn, or a transmitter, are well known in the prior art. For example, see, U.S. Pat. Nos. 3,810,146; 4,079,364; 4,714,914; 4,777,478; 5,025,247; and 5,710,989. Typically, the power source is a battery, and the water activated switching circuit includes a transistor switch, a voltage divider, and a water activated switch in the form of a pair of electrodes. The horn or transmitter is electrically coupled between a positive terminal of a battery and a collector terminal of the transistor switch; the electrodes and the voltage divider are coupled in series between the positive terminal of the battery and a negative terminal of the battery; a base terminal of the transistor switch is electrically coupled to the voltage divider; and an emitter terminal of the transistor switch is electrically coupled to the negative terminal of the battery. The battery and the base terminal of the transistor switch are electrically uncoupled in the absence of both electrodes being simultaneously immersed in a body of water. Consequently, the transistor switch is in a cutoff mode of operation due to the lack of current to the base terminal of the transistor switch, and the transistor switch does not draw current from the battery. As a result, the horn or transmitter serially connected with the transistor switch is in a deactivated state of operation. The battery and the base terminal of the transistor switch are electrically coupled when the electrodes are simultaneously immersed in a body of water. Consequently, the transistor switch transitions to a saturation mode of operation due to the supply of current to the base terminal of the transistor switch, and current is drawn from the battery by the transistor switch to activate the horn or transmitter.

One problem associated with the utilization of a water activated switching circuit is that the magnitude of current supplied to the base terminal necessary to transition and maintain the transistor switch in a saturation mode of operation during the simultaneous immersion of both electrodes in a body of water can be relatively significant. Consequently, the usable life of the battery can be significantly reduced. Another problem with the utilization of a water activated switching circuit is the magnitude of the current drawn by the load placed on the battery due to the horn or transmitter during the simultaneous immersion of both electrodes in a body of water. This load can also significantly reduce the usable life of the battery. What is therefore needed is a water activated means for drawing a negligible amount of electrical power from a power source. What is also needed is a water activated means for isolating the power source from an external load device electrically coupled to the water activated means, e.g. a horn or a transmitter.

SUMMARY OF THE INVENTION

The present invention overcomes the aforementioned drawbacks associated with prior water activated switches. Various aspects of the present invention are novel, non-obvious, and provide various advantages. While the actual nature of the present invention described in detail herein can only be determined with reference to the claims appended hereto, certain features which are characteristic of the present invention disclosed herein can be described briefly.

In accordance with a first aspect of the present invention, a water activated power supply comprises a power source, transistor, and water activated switch. The power source is operable to provide a first electrical power. The transistor consists of a base terminal, a collector terminal electrically coupled to the power source, and an emitter terminal. The water activated switch is operable to conduct the first portion of the first electrical power to the base terminal of the transistor when a body of water contacts said water activated switch whereby the emitter terminal provides a second electrical power.

In accordance with a second aspect of the invention, a water alert device comprises a water activated power supply and a transmitting unit including an encoder and a transmitters. The encoder is operable to provide a transmission word in response to electrical power from the water activated power supply. The transmitter is operable to provide a transmission signal in response to the transmission word and electrical power from the water activated power supply.

In a third aspect of the present invention, a water alert system comprises a water activated power supply, a transmitting unit, and a receiving unit including a receiver and a decoder. The transmitting unit is operable to provide a transmission signal in response to electrical power from the water activated power supply. The receiver is operable to provide a transmission word in response to the transmission signal. The decoder is operable to provide a detection signal that transitions between a first logic state and a second logic state as a function of the absence and presence of the transmission word.

It is a primary objective of the present invention to provide a water activated power supply including a power source and a buffering circuit that isolates the power source from an external load device electrically coupled to the buffering circuit when a body of water and/or another ionized liquid has been detected by the buffering circuit.

It is a secondary objective of the present invention to provide a water activated power supply including a power source, and a buffering circuit that can draw a negligible amount of electrical power from the power source when a body of water and/or another ionized liquid has been detected by the buffering circuit.

These and other objects and advantages of the present invention will become more apparent from a review of the following description of the preferred embodiments of the present inventions.

DESCRIPTION OF THE PREFERRED EMBODIMENTS

Figure 1:
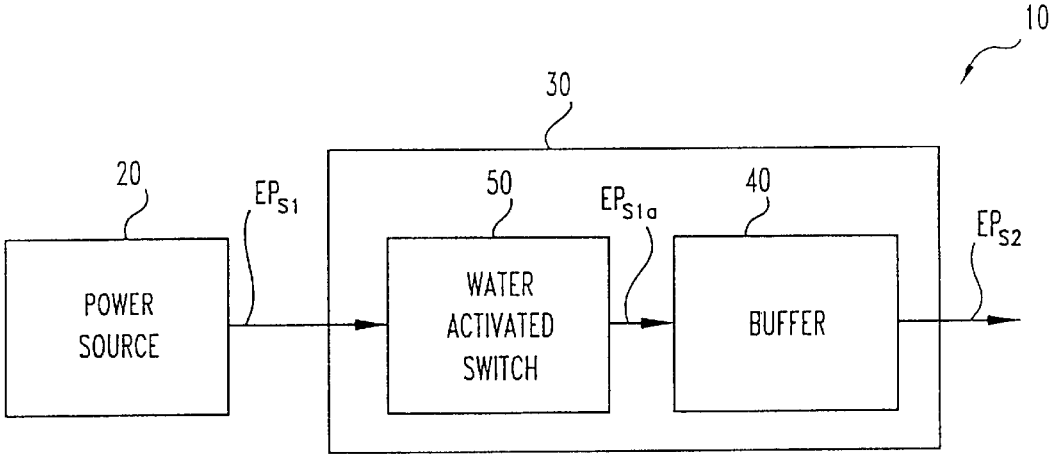
FIG. 1 is a block diagram of a water activated power supply in accordance with the present inventions.

For the purposes of promoting an understanding of the principles of the present invention, reference will now be made to the preferred embodiments of the present invention as illustrated in the drawings and specific language will be used to describe the same. It will nevertheless be understood that no limitation of the scope of the present invention is thereby intended. Any alterations and further modifications in the illustrated embodiments, and any further applications of the principles of the present invention as illustrated herein are contemplated as would normally occur to one skilled in the art to which the present invention relates.

A block diagram of one new and unique water activated power supply 10 for use in a water alert system in accordance with the present inventions is shown in FIG. 1. Referring to FIG. 1, water activated power supply 10 comprises a power source 20, and a buffering circuit 30. In the present embodiment, buffering circuit 30 includes a buffer 40 and a water activated switch 50 which connects buffer 40 to power source 20 when water and/or another ionized liquid are present. For purposes of the present invention, power source 20 is broadly defined as any article or combination of articles operable to generate and output an electrical power consisting of a voltage and a current, e.g. a voltage source or a current source; buffer 40 is broadly defined as any article or combination of articles operable to provide an electrical power consisting of a voltage and a current to an external device being connected to buffering circuit 30 when an input or inputs (not shown) of buffer 40 are electrically coupled to power source 20, e.g. a buffer amplifier or phototransistor; and water activated switch 50 is broadly defined as any article or combination of articles operable to electrically couple at least one input of buffer 40 to power source 20 when water or another ionized liquid contacts water activated switch 50 Water activated switch 50 is electrically coupled to power source 20 and to an input of buffer 40. It is to be appreciated and understood that the input of buffer 40 is electrically coupled to power source 20 when a body of water and/or another ionized liquid (not shown) contacts water activated switch 50.

Consequently, power source 20 provides an electrical power $EP_{S1}$ to water activated switch 50, and buffer 40 receives at least a portion $EP_{S1a}$ of electrical power $EP_{S1}$ via water activated switch 50 when water or another ionized liquid is present across water activated switch 50. As a result, buffer 40 provides an electrical power $EP_{S2}$ at its output. The present invention contemplates that the magnitude of electrical power $EP_{S1}$ required for buffer 40 to output electrical power $EP_{S2}$ is negligible relative to a maximum magnitude of electrical power $EP_{S1}$ that can be generated by power source 20. The present invention further contemplates that the voltage of electrical power $EP_{S2}$ may or may not approximate the voltage of electrical power $EP_{S1}$, and that the current of electrical power $EP_{S2}$ may or may not approximate the current of electrical power $EP_{S1}$.

Still referring to FIG. 1, for purposes of the present invention buffer 40 is further defined as being operable to output electrical power $EP_{S2}$ to an external load device (not shown) electrically coupled to buffer 40 to receive electrical power $EP_{S2}$ while isolating power source 20 from the applied external load device. Additionally, buffer 40 serves to provide an impedance match between a load device and power source 20. The provision of electrical power $EP_{S2}$ to an external load device electrically coupled to buffer 40 is indicative of the presence of an ionized liquid, such as water, by buffering circuit 30. According to the present invention contemplates that water activated switch 50 can be strategically located relative to a person when it is desired to detect the presence of a body of water in contact with the person, e.g. a child in a swimming pool, or when it is desired to detect the presence of a body of water with which the person may come in contact, e.g. a child playing near a swimming pool. Alternatively, the present invention also contemplates that water activated switch 50 can be strategically disposed relative to a location when it is desired to detect the presence of a body of water, e.g. water encircling a base of a sump pump, water present in normally dry areas of a basement, or water at the base of a broken water heater.

Figure 2A:
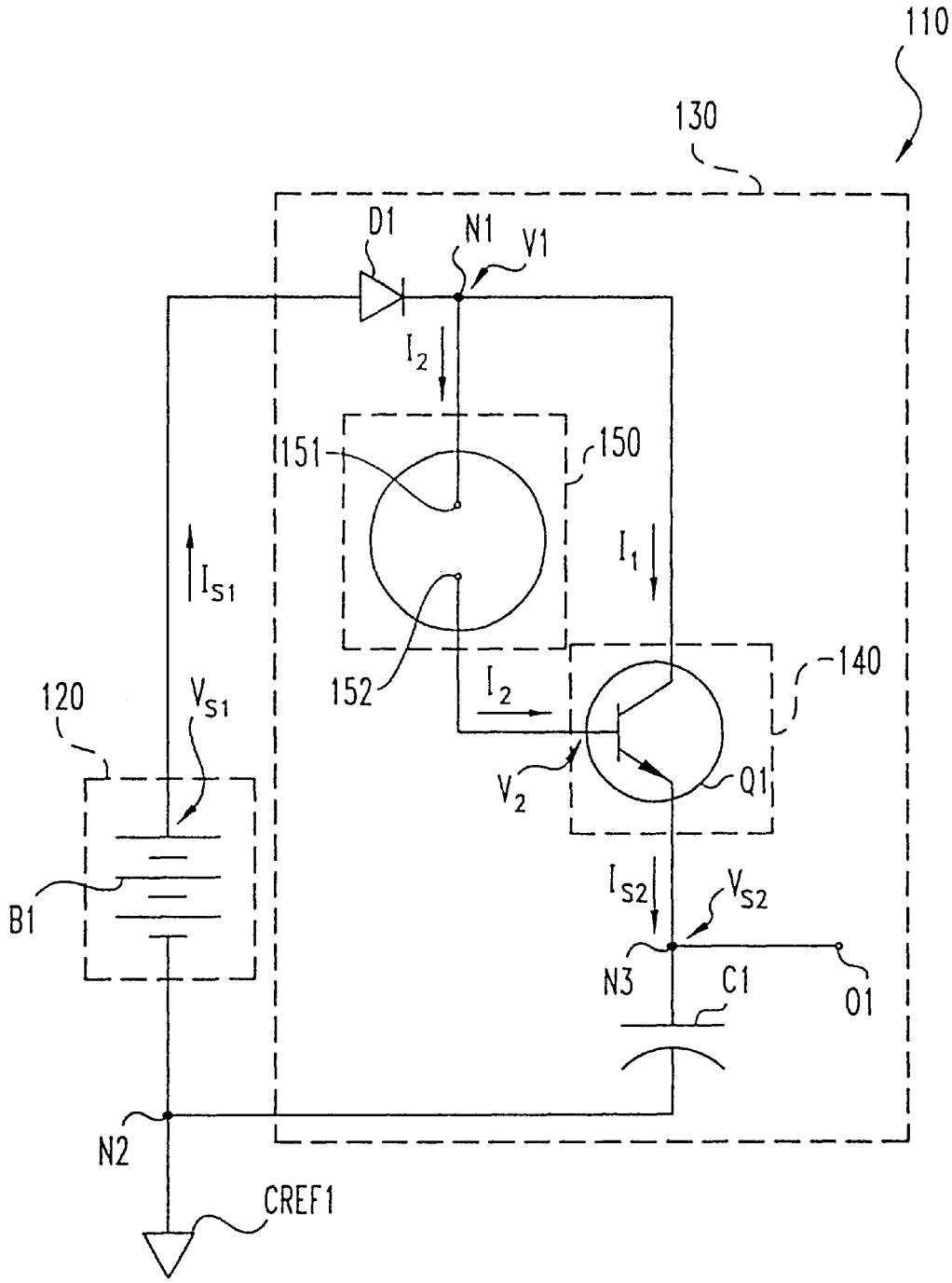
FIG. 2A is a schematic diagram of one embodiment of a water activated power supply.

FIG. 2A is a schematic diagram of one embodiment of a water activated power supply 110. Referring to FIG. 2A, water activated power supply 110 comprises a power source 120, and a buffering circuit 130 including an optional diode D1, a buffer 140, water activated switch 150, an optional capacitor C1, and an output node O1. Power source 120 includes a battery B1 having a positive terminal electrically coupled to an anode terminal of diode D1, and a negative terminal electrically coupled to a common reference CREF1 via a node N2. Buffer 140 includes a transistor Q1 having a control input terminal, a reference input terminal, and an output terminal. The present invention contemplates that transistor Q1 can be any type of NPN transistor. Preferably, as shown in FIG. 2A, transistor Q1 is a bipolar NPN transistor having a base terminal serving as the control input terminal, a collector terminal serving as the reference input terminal, and an emitter terminal serving as the output terminal. The collector terminal of transistor Q1 is electrically coupled to the cathode terminal of diode D1 via a node N1, and the emitter terminal of transistor Q1 is electrically coupled to output node O1 and to a positive terminal of capacitor C1 via node N3. Capacitor C1 has a negative terminal electrically coupled to common reference CREF1 via node N2. Water activated switch 150 further includes a first electrode 151 electrically coupled to the cathode terminal of diode D1 via node N1, and a second electrode 152 electrically coupled to a base terminal of transistor Q1. First electrode 151 and second electrode 152 are spaced to define a normally nonconductive path from the positive terminal of battery B1 to the base terminal of transistor Q1. Thus, it is to be appreciated and understood that current is not being drawn from battery B1 when water or another ionized liquid are is not present between first electrode 151 and second electrode 152 because the base terminal of transistor Q1 is not being electrically coupled to the positive terminal of battery B1, at that time. Consequently, transistor Q1 is in a cutoff mode of operation due to the lack of current to the base terminal of transistor Q1, and transistor Q1 does not draw any current from battery B1. As a result, electrical power $EP_{S2}$ (FIG. 1) is not present at the emitter terminal of transistor Q1.

Still referring to FIG. 2A, an exemplary detection of a body of water by buffering circuit 130 will now be described herein. First electrode 151 and second electrode 152 are electrically coupled when a body of water (not shown) appears between and simultaneously contacts first electrode 151 and second electrode 152 to define a conductive path from the positive terminal of battery B1 to the base terminal of transistor Q1 due to the electrical conductivity of the body of water. It is to be appreciated and understood that the base terminal of transistor Q1 is effectively electrically coupled to the positive terminal of battery B1 to draw a current $I_2$ from battery B1, and the collector terminal of transistor Q1 draws a current $I_1$ from battery B1. Consequently, battery B1 provides a supply voltage $V_{S1}$ and a supply current $I_{S1}$, i.e. electrical power $EP_{S1}$ (FIG. 1). Diode D1 prevents any reverse current flow into the positive terminal of battery B1, and transistor Q1 transitions from a cutoff mode of operation to an active mode of operation due to a proper biasing of a voltage $V_2$ at the base terminal of transistor Q1 and a voltage $V_1$ at the collector terminal of transistor Q1. As a result, transistor Q1 provides a supply voltage $V_{S2}$ and a supply current $I_{S2}$, i.e. electrical power $EP_{S2}$ (FIG. 1), at the emitter terminal of transistor Q1, and capacitor C1 is charged to store supply voltage $V_{S2}$. It is to be appreciated and understood that an electrical power consisting of voltage $V_1$ and current $I_1$ at the collector terminal of transistor Q1, and an electrical power consisting of voltage $V_2$ and current $I_2$ at the base terminal of transistor Q2 collectively constitute portion $EP_{S1a}$ (FIG. 1) of electrical power $EP_{S1}$.

Still referring to FIG. 2A, note that when water or another ionized liquid is present across first electrode 151 and second electrode 152, transistor Q1 is configured as a buffer wherein a magnitude of supply current $I_{S1}$ drawn from power source 120 by the base terminal and the collector terminal of transistor Q1 is negligible, while the emitter terminal of Q1 supplies supply voltage $V_{S2}$ and supply current $I_{S2}$ with reasonable magnitudes to a load device connected to output node O1. Specifically, an external load device (not shown) can be electrically coupled to output node O1 to receive supply voltage $V_{S2}$ and supply current $I_{S2}$ from transistor Q1 when a body of water is simultaneously contacting first electrode 151 and second electrode 152. Additionally, supply voltage $V_{S2}$ and supply current $I_{S2}$ is stored at capacitor C1 for a period of time after a cessation of the body of water and/or another ionized liquid simultaneously contacting first electrode 151 and second electrode 152. Due to the emitter follower configuration of transistor Q1, it is to be appreciated and understood that, depending on the power ratings of battery B1, a magnitude of supply current $I_{S1}$ as it is drawn from battery B1 by the base terminal and the collector terminal of transistor Q1 can be negligible relative to the maximum magnitude of supply current $I_{S1}$ that can be generated by battery B1. It is to be further appreciated that, depending again on the power rating of battery B1, a magnitude of supply voltage $V_{S2}$ can substantially approximates a magnitude of supply voltage $V_{S1}$ (supply voltage $V_{S1}$ equal supply voltage $V_{S1}$ minus a voltage drop across diode D1, although there may be an additional voltage drop due to the resistivity of the water or other ionized liquid across first electrode 151 and second electrode 152). The magnitude of supply current $I_{S2}$ can substantially approximate the magnitude of supply current $I_{S1}$ due to the high current gain factor of transistor Q1. Consequently, the magnitudes of supply voltage $V_{S2}$ and of supply current $I_{S2}$ can reasonably drive a variety of external load devices while having no effect on the magnitude of supply current $I_{S1}$. It is also appreciated that the presence of supply voltage $V_{S2}$ and supply current $I_{S2}$ provide an indication to an external load device of a detected presence of a body of water and/or another ionized liquid by buffering circuit 130. Accordingly, the present inventions contemplate that first electrode 151 and second electrode 152 can be strategically located relative to a person when it is desired to detect the presence of a body of water in contact with the person, e.g. a child in a swimming pool. Alternatively, the present invention also contemplates that first electrode 151 and second electrode 152 can be strategically disposed relative to a location when it is desired to detect the presence of a body of water, e.g. water encircling a base of a sump pump water present in normally dry areas of a basement, or water at the base of a broken water heater.

Figure 2B:
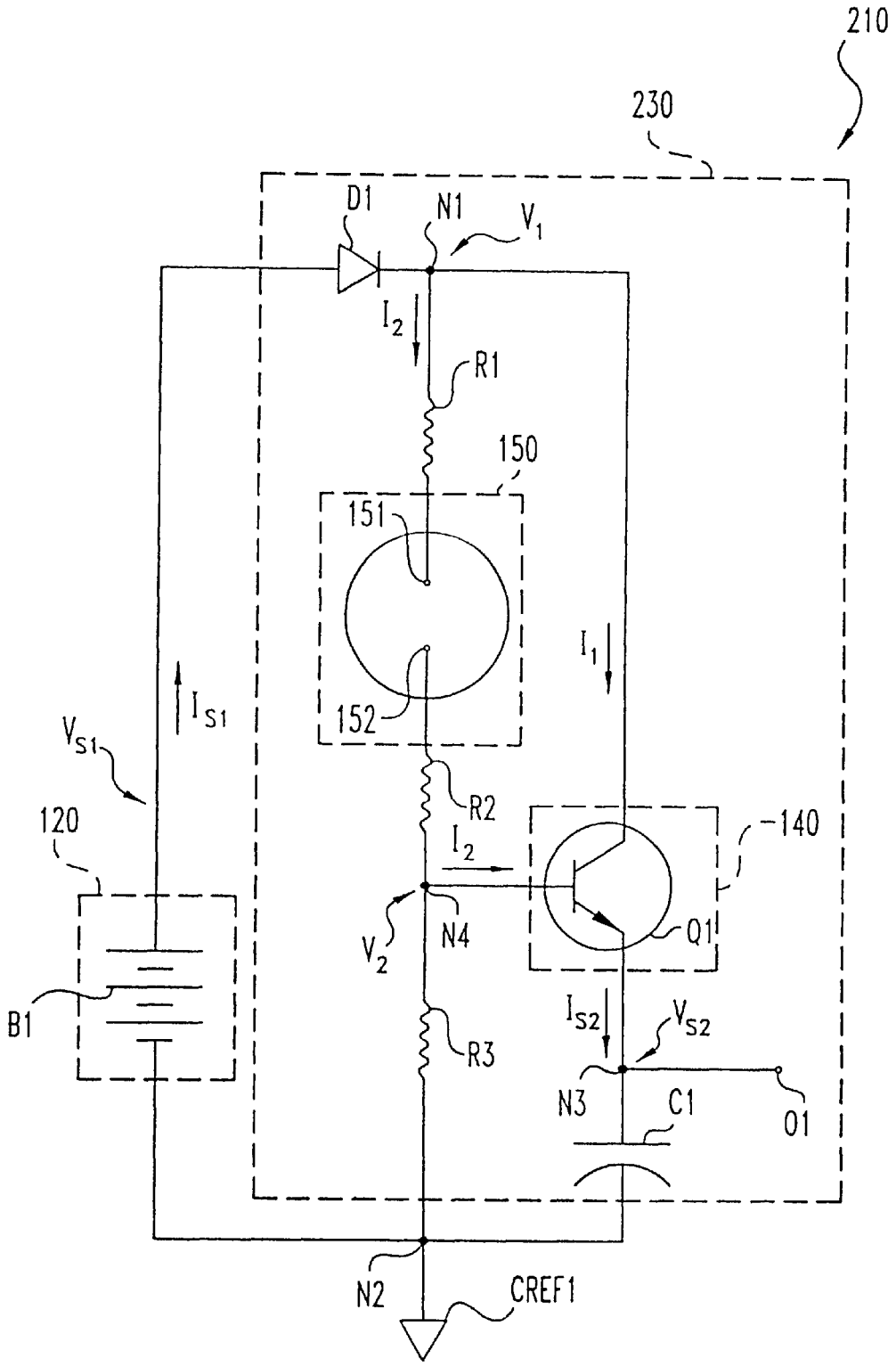
FIG. 2B is a schematic diagram of another embodiment of a water activated power supply.

FIG. 2B is a schematic diagram of another embodiment of a water activated power supply 210 in accordance with the present inventions. Referring to FIG. 2B, water activated power supply 210 comprises power source 120 as previously described in connection with FIG. 2A and accompanying text. Water activated power supply 210 further comprises a buffering circuit 230 as an alternative to buffering circuit 130 (FIG. 2A). Buffering circuit 230 includes optional diode D1, buffer 140, water activated switch 150, optional capacitor C1, and output node O1 as previously described in connection with FIG. 2A and accompanying text. Buffering circuit 230 further includes a resistor R1, a resistor R2, and a resistor R3. A positive terminal of resistor R1 is electrically coupled to the cathode terminal of diode D1 via node N1, and a negative terminal of resistor R1 is electrically coupled to first electrode 151. A positive terminal of resistor R2 is electrically coupled to second electrode 152, and a negative terminal of resistor R2 is electrically coupled to the base terminal of transistor Q1 via a node N4. A positive terminal of resistor R3 is electrically coupled to the base terminal of transistor Q1 and the negative terminal of resistor R2 via node N4, and a negative terminal of resistor R3 is electrically coupled to common reference CREF1 via node N2. Buffering circuit 230 analogously detects a body of water as previously described for buffering circuit 130 in connection with FIG. 2A and accompanying text. It is to be appreciated and understood that a magnitude of voltage $V_2$ is equal to a voltage $V_1$ minus a voltage drop across resistor R1, any voltage drop across first electrode 151 and second electrode 152 due to the resistivity of a body of water and/or another ionized liquid, a voltage drop across resistor R2, and a voltage drop across resistor R3. It is to be further appreciated and understood that the electrical resistivity of resistor R1, the electrical resistivity of resistor R2, and the electrical resistivity of resistor R3 are selected to ensure a proper biasing of voltage $V_2$ at the base terminal of transistor Q1 and voltage $V_1$ at the collector terminal of transistor Q1 when the electrical resistivity of a body of water and/or another ionized liquid simultaneously contacting first electrode 151 and second electrode 152 is solely insufficient to properly bias voltage $V_2$ and voltage $V_1$. Accordingly, the present invention contemplates that resistor R1, resistor R2, resistor R3, or any two of the aforementioned resistors can be eliminated if the electrical resistivity of each remaining resistor is solely or concurrently sufficient to properly bias voltage $V_2$ and voltage $V_1$.

Figure 2C:
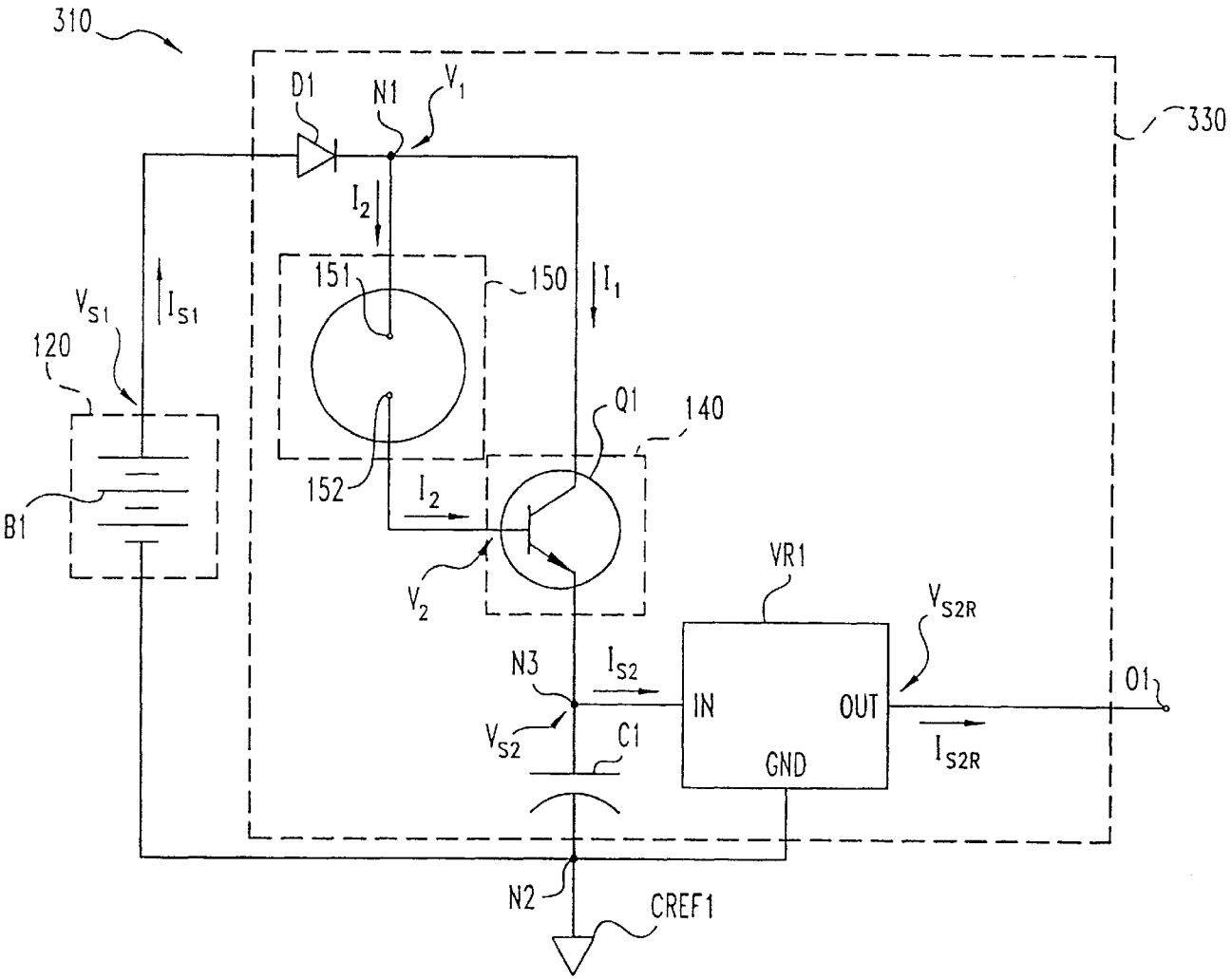
FIG. 2C is a schematic diagram of another embodiment of a water activated power supply.

FIG. 2C is a schematic diagram of another embodiment of a water activated power supply 310 in accordance with the present inventions. Referring to FIG. 2C, water activated power supply 310 comprises power source 120 as previously described in connection with FIG. 2A and accompanying text. Water activated power supply 310 further comprises a buffering circuit 330 as an alternative to buffering circuit 130 (FIG. 2A). Buffering circuit 330 includes optional diode D1, buffer 140, water activated switch 150, optional capacitor C1, and output node O1 as previously described in connection with FIG. 2A and accompanying text. Buffering circuit 330 further includes a voltage regulator VR1. The present invention contemplates that voltage regulator VR1 can be any type of voltage regulator. Preferably, voltage regulator VR1 has an input pin IN, an output pin OUT, and a ground pin GND as shown in FIG. 2C. Input pin IN of voltage regulator VR1 is electrically coupled to the emitter terminal of transistor Q1 and the positive terminal of capacitor C1 via node N3, ground pin GND of voltage regulator VR1 is electrically coupled to common reference CREF1 via node N2, and output pin OUT of voltage regulator VR1 is electrically coupled to output node O1. It is to be appreciated and understood that voltage regulator VR1 generates a regulated supply voltage $V_{S2R}$ at a fixed level and will output regulated supply voltage $V_{S2R}$ to any external load device (not shown) electrically coupled to voltage regulator VR1 via output node O1 when a body of water and/or another ionized liquid is present across first electrode 151 and second electrode 152, and for a short period of time thereafter, if optional capacitor C1 is employed. As a result, water activated power supply 310 can drive an external load device electrically coupled to voltage regulator VR1 for a period of time after battery B1 has been significantly drained.

Figure 3:
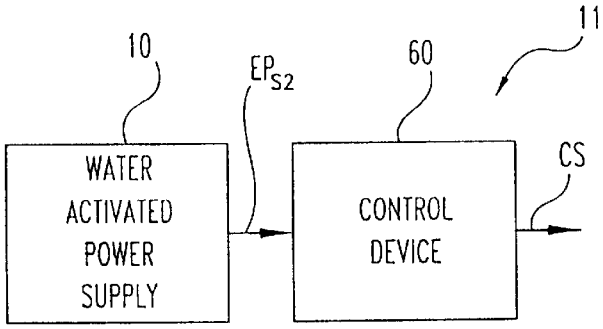
FIG. 3 is a block diagram of one embodiment of a water alert device in accordance with the present invention.

FIG. 3 is a block diagram of a water alert device 11 in accordance with the present inventions. Referring to FIG. 3, water alert device 11 comprises water activated power supply 10 (FIG. 1) and a control device 60 electrically coupled to an output of buffering circuit 30 (FIG. 1) of water activated power supply 10 to receive electrical power $EP_{S2}$. Buffering circuit 30 provides electrical power $EP_{S2}$ as previously described in connection with FIG. 1 and accompanying text. The present invention contemplates control device 60 can be electrically coupled to buffering circuit 30 by any medium. For purposes of the present invention, control device 60 is broadly defined as any article or combination of articles operable to generate and output a control signal CS for controlling the operational acts of an analog and/or digital device electrically coupled to control device 60, e.g. a central processing unit generating and outputting control signal CS to open and close an electronic switch of a sump pump that disables and enables the sump pump. Control signal CS may be outputted in a first logic state in the absence of a body of water and/or another ionized liquid (not shown) being detected by buffering circuit 30. When a body of water and/or another ionized liquid is detected by buffering circuit 30, control device 60 receives electrical power $EP_{S2}$ and switches control signal CS from the first logic state to a second logic state in response to electrical power $EP_{S2}$. It is to be appreciated and understood that water activated power supply 10 provides a signal to control device 60 when the presence of an ionized liquid, such as water, has been detected by buffering circuit 30. This signal enables control device 60 to control any necessary operational acts of an analog and/or digital device via control signal CS, e.g. a central processing unit generating and outputting control signal CS at the second logic level upon the detection of a body of water and/or another ionized liquid by buffering circuit 30 to close an electronic switch of a sump pump that enables the sump pump to prevent a basement from flooding. It is to be further appreciated and understood that buffer 40 (FIG. 1) isolates power source 20 (FIG. 1) from control device 60 to prevent control device 60. The present inventions contemplate that control device 60 can receive electrical power $EP_{S2}$ at one or more inputs, and can output more than one control signal CS. The present inventions further contemplate that control device 60 can latch electrical power $EP_{S2}$ and/or control signal CS.

Figure 4:
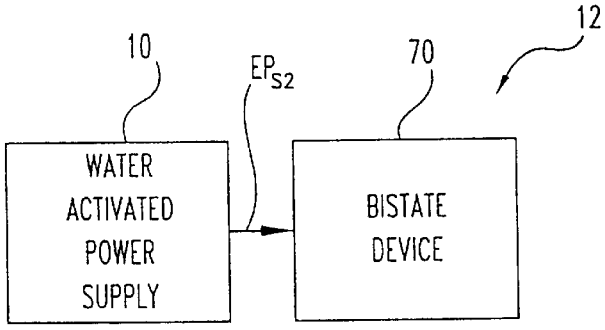
FIG. 4 is a block diagram of another embodiment of a water alert device in accordance with the present invention.

FIG. 4 is a block diagram of a water alert system 12 in accordance with one embodiment of the present inventions. Referring to FIG. 4, water alert system 12 comprises water activated power supply 10 (FIG. 1) and a bistate device 70 electrically coupled to buffering circuit 30 (FIG. 1) of water activated power supply 10 to receive electrical power $EP_{S2}$. Buffering, circuit 30 provides electrical power $EP_{S2}$ as previously described in connection with FIG. 1 and accompanying text. The present invention contemplates bistate device 70 can be electrically coupled to buffering circuit t 30 by any medium. For purposes of the present invention, bistate device 70 is broadly defined as any article or combination of articles operable to be transitional between two discrete states of operation., e.g. an indicator like a horn or a light, a transmitter, etc. Bistate device 70 is in a first state in the absence of a body of water and/or another ionized liquid (not shown) being, detected by buffering, circuit 310. When a body of water and/or another ionized liquid is detected by buffering, circuit 310, bistate device 70 receives electrical power $EP_{S2}$ and switches from the first state to a second state in response to electrical power $EP_{S2}$, e.g. bistate device 70 turns on. It is to be appreciated and understood that water activated power supply 10 triggers bistate device 70 to perform any necessary transitional acts upon the detection of a body of water and/or another ionized liquid by buffering circuit 30, e.g. a horn transitioning from a deactivated state to an activated state, a light transitioning from off state to an on state, etc. It is to be further appreciated and understood that buffer 40 (FIG. 1) isolates power source 20 (FIG. 1) from bistate device 70 to prevent bistate device. The present inventions contemplate that bistate device 70 can receive electrical power $EP_{S2}$ at one or more inputs. The present inventions further contemplate that bistate device 70 can latch electrical power $EP_{S2}$. Note that bistate device 70 may be integral with water activated power supply 10, such as on a one piece alarm device unit the can be worn on the garment or wrist of a child. Alternatively, bistate device 70 may be located distally from at least water activated switch 50 (FIG. 1) or a portion thereof, but electrically in communication therewith, such as in the case where any electrodes of water activated switch 50, e.g. first electrode 151 and second electrode 152 (FIGS. 2A–2C), are extended away from the alarm system housing by electrical leads, for example, to be in contact with a basement floor near a sump pump, while the remaining circuitry of buffering circuit 30, or at least bistate device 70, is located on higher ground.

Figure 5:
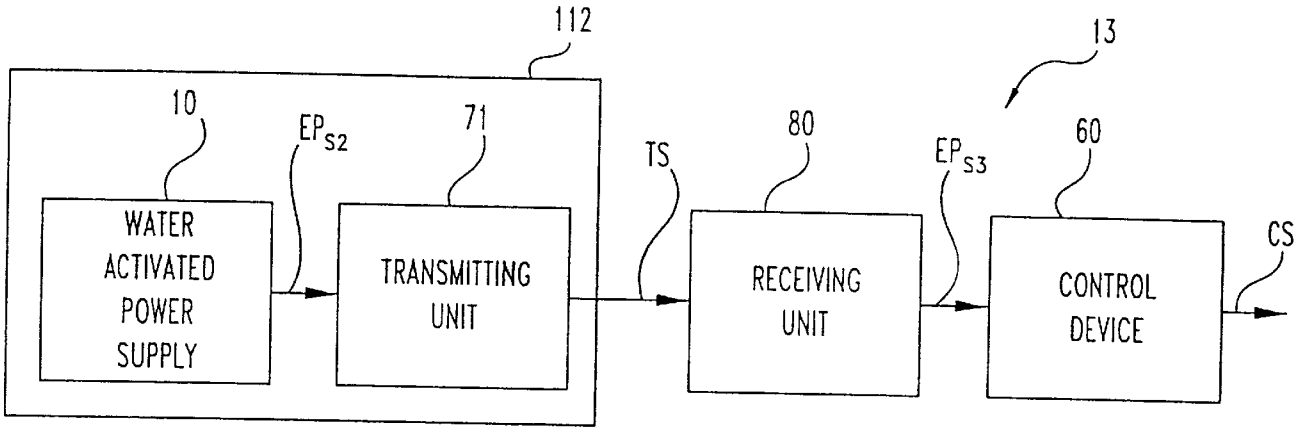
FIG. 5 is a block diagram of one embodiment of a water alert system in accordance with the present invention.

FIG. 5 is a block diagram of one embodiment of a water alert system 13 in accordance with the present inventions. Referring to FIG. 5, water alert system 13 comprises a water alert device 112 including water activated power supply 10 (FIG. 1), and a transmitting unit 71 electrically coupled to buffering circuit 30 (FIG. 1) of water activated power supply 10 to receive electrical power $EP_{S2}$. Buffering circuit 30 provides electrical power $EP_{S2}$ as previously described in connection with FIG. 1 and accompanying text. The present invention contemplates transmitting unit 71 can be electrically coupled to buffering circuit 30 by any medium. For purposes of the present invention, transmitting unit 71 is any article or combination of articles operable to transmit a transmission signal. Transmitting unit 71 is in a deactivated state in the absence of a body of water and/or another ionized liquid (not shown) across water activated switch 50 (FIG. 1) of buffering circuit 30. When a body of water and/or another ionized liquid is detected by buffering circuit 30, transmitting unit 71 receives electrical power $EP_{S2}$ and transitions to an activated state to transmit a transmission signal TS in response to electrical power $EP_{S2}$. It is to be appreciated and- understood that buffer 40 (FIG. 1) isolates power source 20 (FIG. 1) from transmission unit 71 to prevent transmission unit 71. The present invention contemplates that transmission unit 71 can latch electrical power $EP_{S2}$ and/or transmission signal TS. Water alert system 13 further comprises a receiving unit 80 and control device 60 (as previously described in connection with FIG. 3 and accompanying text) electrically coupled to receiving unit 80. For purposes of the present invention, receiving unit 80 is broadly defined as any article or combination of articles operable to generate an electrical power consisting of a voltage and a current to an external load device applied to receiving unit 80, e.g. control device 60, in response to a transmission signal.

Receiving unit 80 is in a deactivated state in the absence of a body of water and/or another ionized liquid (not shown) across water activated switch 50. When a body of water is detected by buffering circuit 30, transmitting unit 71 outputs transmission signal TS and receiving unit 80 outputs an electrical power $EP_{S3}$ or a portion thereof to control device 60. The present invention contemplates that transmission signal TS can be transmitted from transmitting unit 71 to receiving unit 80 by any medium, such as by a broadcast or wired path or by using optical or sound/pressure wave signaling, as desired. Additionally, electrical power $EP_{S3}$ or a portion thereof can be transmitted to control device 60 by any medium, e.g. wired, optical, etc. The present invention further contemplates that receiving unit 80 can latch transmission signal TS and/or electrical power $EP_{S3}$ or a portion thereof. Control device 60 receives electrical power $EP_{S3}$ or a portion thereof from receiving unit 80 and analogously outputs control signal CS in response to electrical power $EP_{S3}$ or a portion thereof relative to electrical power $EP_{S2}$ as previously described in connection with FIG. 3 and accompanying text.

Figure 6:
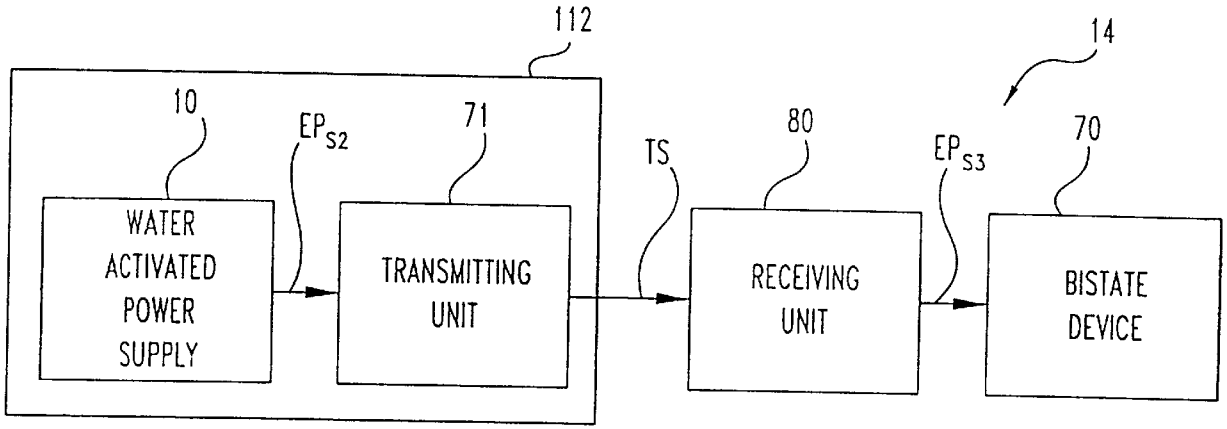
FIG. 6 is a block diagram of another embodiment of a water alert system in accordance with the present invention.

FIG. 6 is a block diagram of a water alert system 14 in accordance with one embodiment of the present inventions. Referring to FIG. 6, water alert system 14 comprises water activated device 112, and receiving unit 80 as previously described in connection with FIG. 5 and accompanying text. Water alert system 14 further comprises bistate device 70 as previously described in connection with FIG. 5 and accompanying Transmitting unit 71 is in a deactivated state in the absence of a body of water and/or another ionized liquid (not shown) across water activated switch 50. When a body of water is detected by buffering circuit 30, transmitting unit 71 outputs transmission signal TS and receiving unit 80 outputs an electrical power $EP_{S3}$ or a portion thereof to bistate device 70. The present invention contemplates that power $EP_{S3}$ or a portion thereof can be supplied to bistate device 70 by any medium. Bistate device 70 receives electrical power $EP_{S3}$ from receiving unit 80 and analogously switches states in response to electrical power $EP_{S3}$ or a portion thereof relative to electrical power $EP_{S2}$ as previously described in connection with FIG. 4 and accompanying text.

Figure 7:
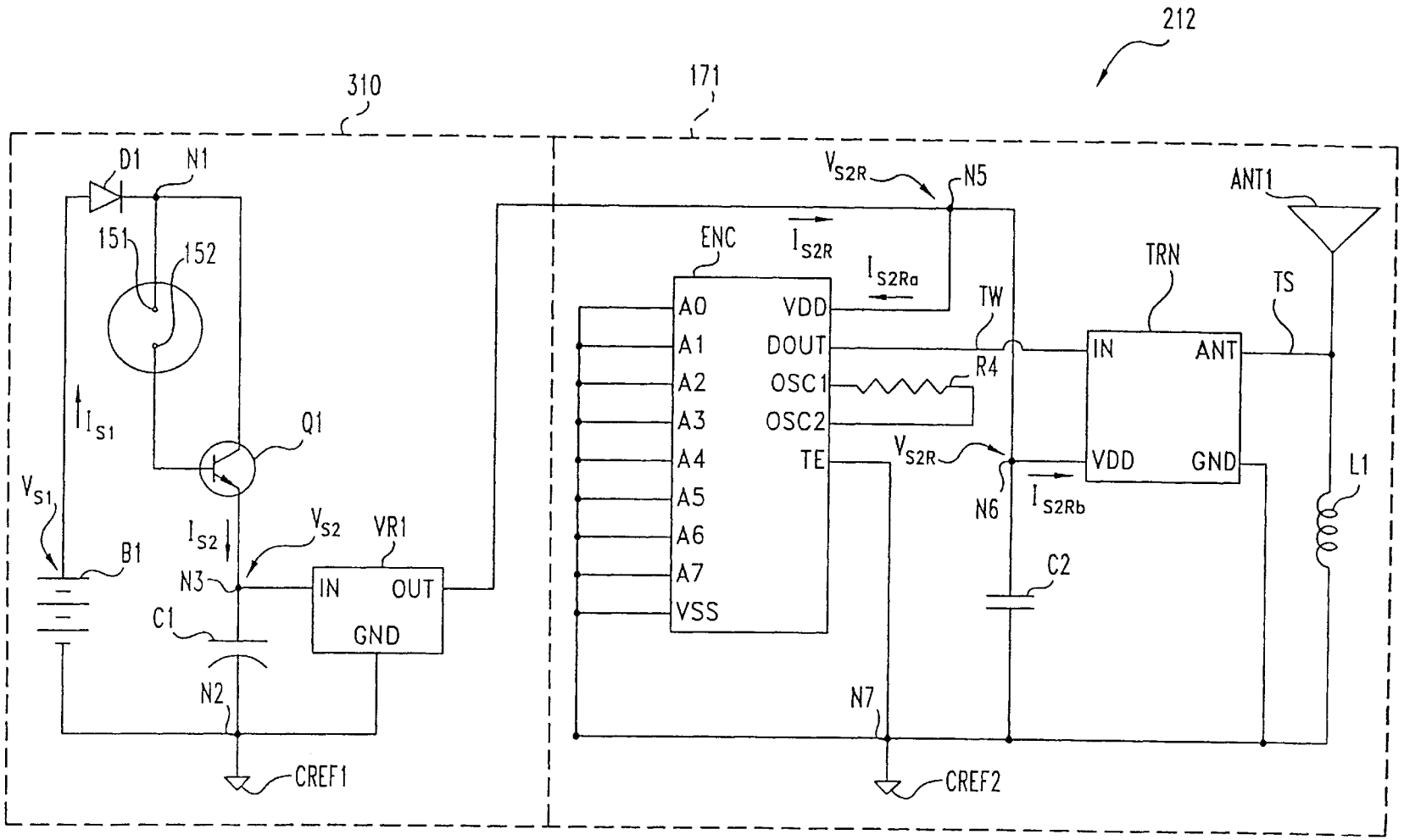
FIG. 7 is a schematic diagram of one embodiment of the water activated power supply and a transmitting unit of FIGS. 5 and 6.

FIG. 7 is a schematic diagram of one preferred embodiment of a water alert device 212. Referring to FIG. 7, water alert device 212 comprises water activated power supply 310 as previously described in connection with FIG. 2C and accompanying text, although water activated power supply 110 (FIG. 2A), water activated power supply 210 (FIG. 2B) and any other water activated power supply in accordance with the principles of the present invention could alternatively be used. Water alert device 212 further comprises a transmitting unit 171 including an encoder ENC, a transmitter TRN, a transmitting antenna ANT1, a resistor R4, an optional capacitor C2, and an optional inductor L1. The present invention contemplates that encoder ENC can be any type of encoder. Preferably, encoder ENC has address pins A0, A1, A2, A3, A4, A5, A6, and A7; a negative power supply pin VSS; a positive power supply pin VDD; a data serial transmission output pin DOUT; an oscillator input pin OSC1; an oscillator output pin OSC2; and a transmission enable pin TE as shown in FIG. 7.

Negative power supply pin VSS and transmission enable pin TE are electrically coupled to a common reference CREF2 via a node N7, and positive power supply pin VDD is electrically coupled to output pin OUT of voltage regulator VR1 via a node N5 to receive regulated supply voltage $V_{S2R}$ and a portion $I_{S2Ra}$ of regulated supply current $I_{S2R}$ at positive power supply pin VDD. Encoder ENC serially outputs a transmission word TW consisting of a synchronization bit and a set of information bits at data serial transmission output pin DOUT in response to regulated supply voltage $V_{S2R}$ and a portion $I_{S2Ra}$ of regulated supply current $I_{S2R}$ at positive power supply pin VDD. Address pins A0–A7 are electrically coupled to common reference CREF2 to fixedly assign each information bit of transmission word TW as a 0 or a 1. Resistor R4 electrically couples oscillator input pin OSC1 and oscillator output pin OSC2 to set a transmission rate of transmission word TW.

Still referring to FIG. 7, the present invention contemplates that transmitter TRN can be any type of transmitter. Preferably, transmitter TRN is an RF transmitter having a data input pin IN, a positive power supply pin VDD, a negative power supply pin VSS, and an antenna pin ANT as shown in FIG. 7. Positive power supply pin VDD is electrically coupled to output pin OUT of voltage regulator VR1 via a node N6, and negative power supply pin VSS is electric ally coupled to common reference CREF2 via node N7 to receive regulated supply voltage $V_{S2R}$ and a portion $I_{S2Rb}$ of regulated supply current $I_{S2R}$ at positive power supply pin VDD. Data input pin IN is electrically coupled to data serial transmission output pin DOUT of encoder ENC to serially receive transmission word TW in response to regulated supply voltage $V_{S2R}$ and portion $I_{S2Rb}$ of regulated supply current $I_{S2R}$. Capacitor C2 electrically couples output pin OUT of voltage regulator VR1 to common reference CREF2 via node N7 to eliminate any noise at node N5 and node N6. RF transmitter TRN processes transmission word TW to generate and output a transmission signal TS at antenna pin ANT in response to portion $EP_{2Rb}$ of regulated supply of power $EP_{2R}$ and transmission word TW. Antenna pin ANT is electrically coupled to transmitting antenna ANT1 to transmit transmission signal TS to a receiving unit, e.g. a receiving unit 180 (FIG. 8A) or a receiving unit 280 (FIG. 8B). A positive terminal of inductor L1 is electrically coupled to transmitting antenna ANT1 and a negative terminal of inductor L1 is electrically coupled to common reference CREF2 via node N7 to protect RF transmitter TRN from any damage due to static electricity.

Figure 8A:
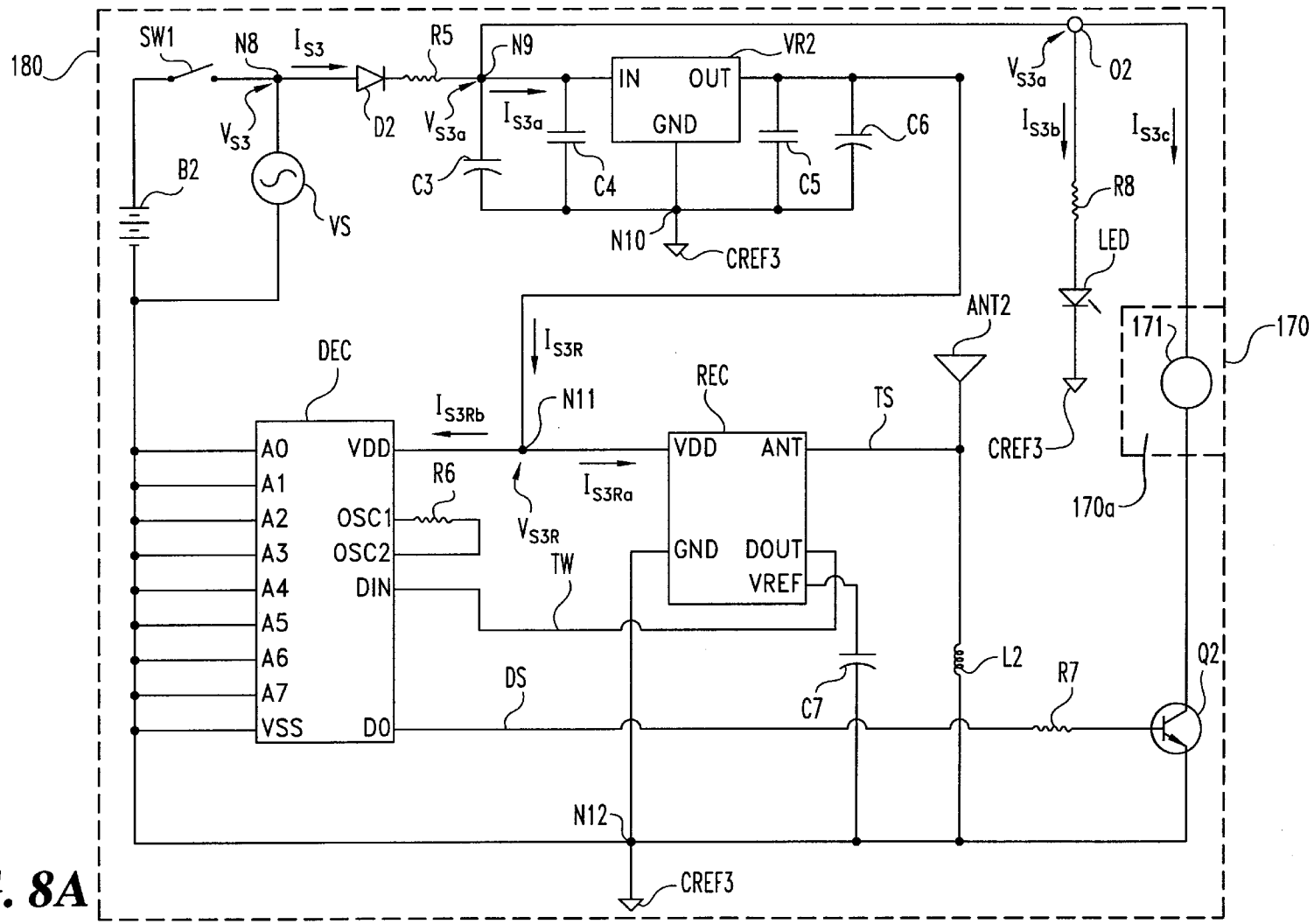
FIG. 8A is a schematic diagram of one embodiment of a receiving unit and a bistate device of the water alert system of FIG. 6.
Figure 8B:
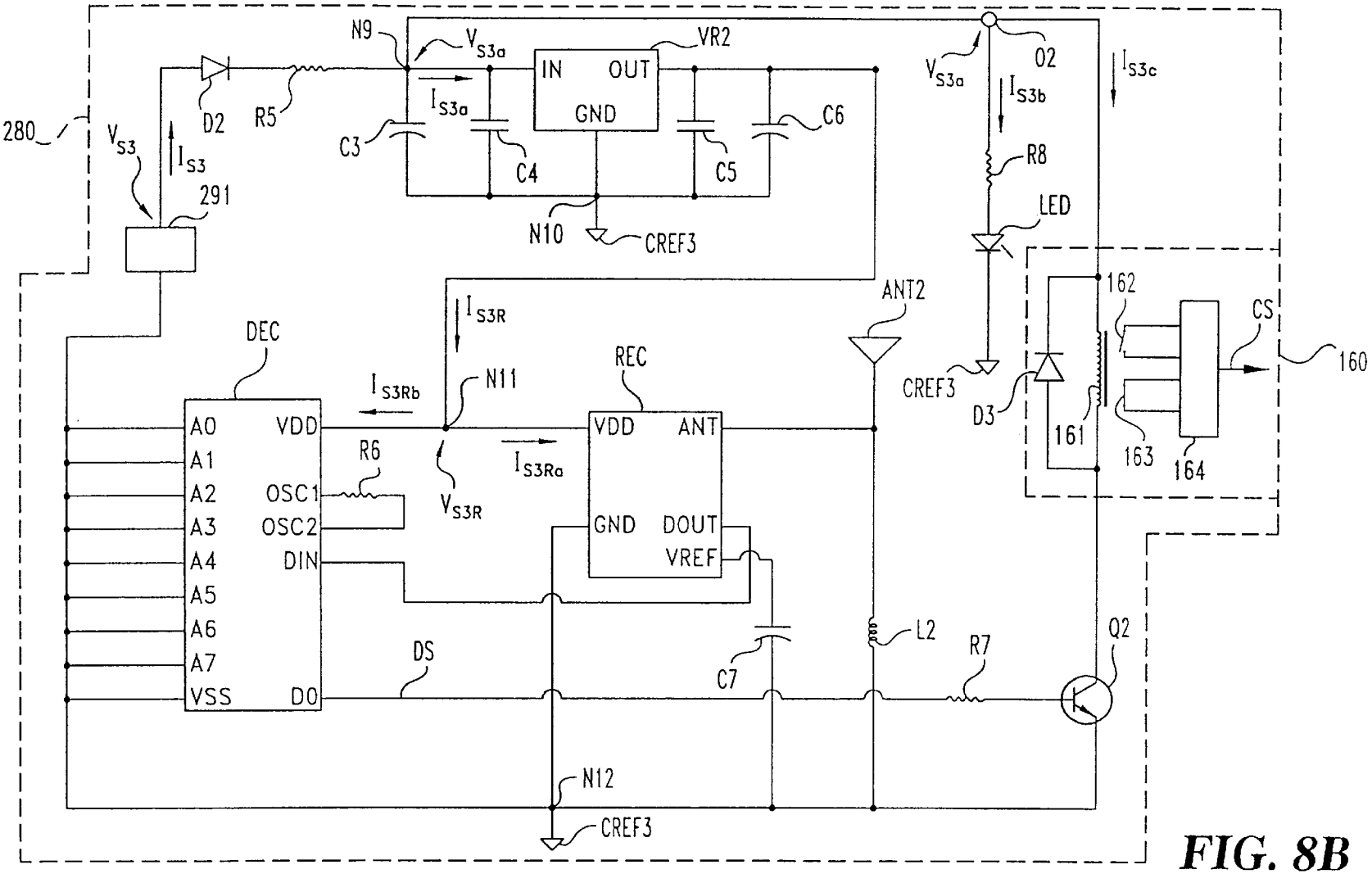
FIG. 8B is a schematic diagram of one embodiment of a receiving unit and a control device of the water alert system of FIG. 5.

FIG. 8A is a schematic diagram of a receiving unit 180, and a bistate device 170 including an indicator 170*a*, e.g. a horn, a bell, a light, etc. Referring to FIG. 8A, receiving unit 180 includes a battery B2; a voltage source adapter VS; a common reference CREF3; a switch SW1; a diode D2; an optional resistor R5; a voltage regulator VR2; an optional capacitor C3; an optional capacitor C4, an optional capacitor C5; optional capacitor C6; a decoder DEC; a resistor R6; a receiver REC; an optional capacitor C7; a receiving antenna ANT2; an optional inductor L2; a transistor Q2; an optional resistor R7; an output node O2; an optional resistor R8; and a light-emitting diode LED. A positive terminal of battery B2 is electrically coupled to a first cornnector of switch SW1, a negative terminal of battery B2 is electrically coupled to a common reference CREF3 via a node N12, and a second connector of switch SW1 is electrically coupled to an anode terminal of diode D2 via a node N8 to generate and output an electric power consisting of a supply voltage $V_{S3a}$ and a supply current $I_{S3a}$ to node N8 when switch SW1 is closed. A positive terminal of voltage source adapter VS is electrically coupled to the anode terminal of diode D2, and a negative terminal of voltage source adapter VS is electrically coupled to common reference CREF2 via node N12 to generate and output the electric power consisting of supply voltage $V_{S3a}$ and supply current $I_{S3A}$ to node N8 when switch SW1 is opened. It is to be appreciated that voltage source adapter VS can be electrically coupled to an ac voltage source to bypass switch SW1, and as such, receiving unit 180 can not be accidentally turned off when voltage source adapter VS is electrically coupled to an ac voltage source. The present invention contemplates that voltage source adapter VS is any article or combination of articles for electrically coupling with an ac voltage source.

Still referring to FIG. 8A, the present invention contemplates that voltage regulator VR2 can be any type of voltage regulator. Preferably, voltage regulator VR2 has an input pin IN, an output pin OUT, and a ground pin GND as shown in FIG. 8A. A cathode terminal of diode D2 is electrically coupled to a positive terminal of resistor R5 and a negative terminal of resistor R5 is electrically coupled to input pin IN of voltage regulator VR2 via a node N9, and ground pin GND of voltage regulator VR2 is electrically coupled to common reference CREF3 via a node N10 to receive a portion $V_{S3a}$ of supply voltage $V_{S3}$, and a portion $I_{S3a}$ of supply current $I_{S3}$ at input pin IN of voltage regulator VR2. A positive terminal of capacitor C3 is electrically coupled to the negative terminal of resistor R5 via node N9 and a negative terminal of capacitor C3 is electrically coupled to common reference CREF3 via node 10 to store portion $V_{S3a}$ of supply voltage $VS_3$. A positive terminal of capacitor C4 is electrically coupled to the negative terminal of resistor R5 via node N9 and a negative terminal of capacitor C4 is electrically coupled to common reference CREF3 via node 10 to remove any noise at node 9. Voltage regulator VR2 outputs a regulated electrical power consisting of a regulated supply voltage $V_{S3R}$ and a regulated supply current $I_{S3R}$ at output pin OUT in response to portion $V_{S3a}$ of supply voltage $V_{S3}$ and portion $I_{S3a}$ of supply current $I_{S3}$. A positive terminal of capacitor C5 is electrically coupled to output pin OUT of voltage regulator VR2 and a negative terminal of capacitor C5 is electrically coupled to common reference CREF3 via node 10 to remove any noise at node 9. A positive terminal of capacitor C6 is electrically coupled to output pin OUT of voltage regulator VR2 and a negative terminal of capacitor C6 is electrically coupled to common reference CREF3 via node 10 to store regulated supply voltage $V_{S3R}$.

Still referring to FIG. 8A, receiving antenna ANT2 receives transmission signal TS from transmitting antenna ANT1 (FIG. 7) of transmitting unit 171. A positive terminal of inductor L2 is electrically coupled to receiving antenna ANT2 and a negative terminal of inductor L2 is electrically coupled to common reference CREF3 via node 12 to prevent any damage to receiver REC due to static electricity. The present invention contemplates that receiver REC can be any type of receiver. Preferably, receiver REC is an RF receiver having a positive power supply pin VDD, a ground pin GND, an antenna input pin ANT, a data serial transmission output pin DOUT, and a voltage reference pin VREF. Ground pin GND is electrically coupled to common reference CREF3 via a node N12 and positive power supply pin VDD is electrically coupled to output pin OUT of voltage regulator VR2 via a node N11 to receive regulated supply voltage $V_{S3R}$ and a portion $I_{S3Ra}$ of regulated supply current $I_{S3R}$ at positive power supply pin VDD. A positive terminal of capacitor C7 is electrically coupled to voltage reference pin VREF of receiver REC and a negative terminal of capacitor C8 is electrically coupled to common reference CREF3 via node 12. Antenna pin ANT of receiver REC is electrically coupled to receiving antenna ANT2 to receive transmission signal TS, and receiver REC outputs transmission word TW at data serial transmission output pin DOUT in response to transmission signal TS, regulated supply voltage $V_{S3R}$, and portion $I_{S3Ra}$ of regulated supply current $I_{S3R}$.

Still referring to FIG. 8A, the present invention contemplates that decoder DEC can be any type of decoder. Preferably, decoder DEC has address pins A0, A1, A2, A3, A4, A5, A6, and A7; a negative power supply pin VSS; a positive power supply pin VDD; an oscillator input pin OSC1; an oscillator output pin OSC2; a data serial transmission input pin DIN; and a data output pin D0 as shown in FIG. 8A. Address pins A0–A7 are electrically coupled to common reference CREF3 via node N12 to authenticate transmission word TW. Negative power supply pin VSS is electrically coupled to common reference CREF3 via a node N12 and positive power supply pin VDD is electrically coupled to output pin OUT of voltage regulator VR2 via a node N11 to receive regulated supply voltage $V_{S3R}$ and a portion $I_{S3Rb}$ of regulated supply current $I_{S3R}$ at positive supply pin VDD. Data serial transmission input pin DIN is electrically coupled to data serial transmission output pin DOUT of receiver REC to receive transmission signal TS. Resistor R6 electrically couple oscillator input pin OSC1 and oscillator output pin OSC2 to set a receiving rate of transmission word TW. Decoder DEC serially outputs a detection signal DS from data output pin D0 in a logic low state in the absence of either transmission word TW at data serial transmission input pin DIN, and outputs detection signal DS from data output pin D0 in a logic high state in response to transmission word TW at data serial transmission input pin DIN.

Still referring to FIG. 8A, output node O2 is electrically coupled to the cathode terminal of diode D2 via node N9. A positive terminal of resistor R8 is electrically coupled to output node O2, a negative terminal of resistor R8 is electrically coupled to an anode terminal of light-emitting diode LED, and a cathode terminal of light-emitting diode LED is electrically coupled to common reference CREF3 to activate light-emitting diode LED in response to portion $V_{S3a}$ of supply voltage $V_{S3}$, and a portion $I_{S3b}$ of supply current $I_{S3}$. Activation of light-emitting diode LED is an indication that receiving unit 180 is active. A positive terminal of indicator 170*a* is electrically coupled to output node O2, and a negative terminal of indicator 170*a* is electrically coupled to a terminal of transistor Q2. The present invention contemplates that transistor Q2 is any type of NPN transistor. Preferably, transistor Q2 is a bipolar NPN transistor as shown in FIG. 8A having a collector terminal electrically coupled to a negative terminal of indicator 171, and an emitter terminal electrically coupled to common reference CREF3 via node N12. A positive terminal of resistor R7 is electrically coupled to data output pin DO of decoder DEC and a negative terminal of resistor R7 is electrically coupled to a base terminal of transistor Q2. Transistor Q2 is in a cutoff mode of operation when detection signal DS is in a logic low state. Consequently, portion $V_{S3a}$ of supply voltage $VS_3$, and a portion $I_{S3c}$ of supply current $I_{S3}$ are not conducted to indicator 170*a*, and as a result, indicator 171 is deactivated. Transistor Q2 is in a saturation mode of operation when detection signal DS is in a logic high state. Consequently, portion $V_{S3a}$ of supply voltage $VS_3$, and portion $I_{S3c}$ of supply current $I_{S3}$ are conducted to indicator 171, and as a result, indicator 171 is activated.

FIG. 8B is a schematic diagram of a receiving unit 280, and a control device 160. Referring to FIG. 8B, receiving unit 280 comprises diode D2; resistors R5, R6, R7, and R8; capacitors C3, C4, C5, C6, C7 and C8; output nodeO2; voltage regulator VR2 light-emitting diode LED; receiving antenna ANT2; receiver REC; decoder DEC; inductor L2; and NPN transistor Q2 as previously described in FIG. 8A and accompanying text. Receiving unit 280 further comprises an interface 291 as an alternative to battery B2 (FIG. 8A) and voltage source adapter (FIG. 8A) of receiving unit 180. The present invention contemplates that interface 291 is any article or combination of articles for electrically coupling receiving unit 280 and a power source from an external system, e.g. an alarm system. Interface 291 is electrically coupled to the anode terminal of diode D2, and to common reference CREF3 via node N12. Interface 291 provide an electrical power consisting supply voltage $V_{S3}$ and supply current $I_{S3}$ from an external power source. Control device 160 includes a coil 161, a first relay 162, a second relay 163, an interface 164, and a diode D3. Coil 161 has a positive terminal electrically coupled to output node O2 and a negative terminal electrically coupled to the collector terminal of transistor Q2 to generate a magnetic field (not shown) in response to portion $I_{S3c}$ of supply current $I_{S3}$ when transistor Q2 is turned on as previously described in FIG. 8A and accompanying text. Relay 162 is normally opened and relay 163 is normally closed as shown in FIG. 8B prior to the presence of the magnetic field. Consequently, interface 164 outputs control signal in a first logic state to indicate a body of water has not been detected by buffering circuit 30 (FIG. 1) of water activated power supply 10 (FIG. 1). Relay 162 is closed and relay 163 is opened in the presence of the magnetic field. Consequently, interface 164 outputs control signal in a second logic state to indicate a body of water across water activated switch 50 (FIG. 1) of buffering circuit 30 (FIG. 1). Diode D3 is electrically coupled in parallel to coil 11 to prevent a voltage surge from damaging coil 161 as the magnetic field collapses when transistor Q2 is cutoff as previously described in FIG. 8A and accompanying text. The present invention contemplates that interface 164 is any article or combination of articles for outputting control signal CS to an external system, e.g. a household or office complex alarm system, or automatic voice phone dialer.

While the present invention has been illustrated and described in detail in the drawings and foregoing description, the same is to be considered as illustrative and not restrictive in character. For example, in connection with embodiments of FIGS. 5 and 6, it may be possible to adapt control device 60 and/or bistate device 70, such as control signal CS is produced and/or bistate device 70 changes states in response to a signal from receiving unit 80, and not necessarily electrical power $EP_{S3}$ or a portion thereof. It being understood that the preferred embodiments have been shown and described, and that all changes and modifications that come within the spirit of the invention are desired to be protected.

What is claimed is:

1. A water alert device comprising:

a power source operable to provide a first electrical power;

a buffering circuit including a buffer operable to provide a second electrical power in response to a first portion of said first electrical power, and a water activated switch operable to conduct said first portion of said first electrical power to said buffer when a body of water contacts said water activated switch; and a transmitting unit including an encoder operable to provide a transmission word in response to a first portion of said second electrical power, and a transmitter operable to provide a transmission signal in response to said transmission word and a second portion of said second electrical power, and wherein said encoder includes a first oscillator input pin, a second oscillator input pin, and a resistor electrically coupled to said first oscillator input pin and said second oscillator input pin to thereby establish a transmission rate for said transmission word.

2. A water alert system comprising:

a power source operable to provide a first electrical power;

a buffering circuit including a buffer operable to provide a second electrical power in response to a first portion of said first electrical power, and a water activated switch operable to conduct said first portion of said first electrical power to said buffer when a body of water contacts said water activated switch;

a transmitting unit operable to provide a transmission signal in response to said second electrical power; and a receiving unit including a receiver operable to provide said transmission word in response to said transmission signal, and a decoder operable to provide a detection signal, said detection signal being in a first logic state in an absence of said transmission word and said detection signal being in a second logic state in response to said transmission word; and wherein said decoder includes a first oscillator input pin, a second oscillator input pin, and a resistor electrically coupled to said first oscillator input pin and said second oscillator input pin to thereby establish a reception rate for said transmission word.

3. A water alert system comprising:

a power source operable to provide a first electrical power;

a buffering circuit including a buffer operable to provide a second electrical power in response to a first portion of said first electrical power, and a water activated switch operable to conduct said first portion of said first electrical power to said buffer when a body of water contacts said water activated switch;

a transmitting unit operable to provide a transmission signal in response to said second electrical power; and a receiving unit including a receiver operable to provide said transmission word in response to said transmission signal, a decoder operable to provide a detection signal, said detection signal being in a first logic state in an absence of said transmission word and said detection signal being in a second logic state in response to said transmission word, and a bistate device, wherein said bistate device is in a first state in response to said detection signal being in said first logic state and said bistate device is in a second state in response to said detection signal being in said second logic state, a transistor electrically coupled to said bistate device; and a resistor electrically coupled to said transistor and said decoder.

4. A water alert system comprising:

a power source operable to provide a first electrical power;

a buffering circuit including a buffer operable to provide a second electrical power in response to a first portion of said first electrical power, and a water activated switch operable to conduct said first portion of said first electrical power to said buffer when a body of water contacts said water activated switch;

a transmitting unit operable to provide a transmission signal in response to said second electrical power; and a receiving unit including a receiver operable to provide said transmission word in response to said transmission signal, a decoder operable to provide a detection signal, said detection signal being in a first logic state in an absence of said transmission word and said detection signal being in a second logic state in response to said transmission word, and a control device operable to provide a control signal, wherein said control signal is in a third logic state in response to said detection signal being in said first logic state and said control signal is in a fourth logic state in response to said detection signal being in said second logic state, a transistor electrically coupled to said control device; and a resistor electrically coupled to said transistor and said decoder.

5. A water alert system comprising:

a power source operable to provide a first electrical power;

a buffering circuit including a buffer operable to provide a second electrical power in response to a first portion of said first electrical power, and a water activated switch operable to conduct said first portion of said first electrical power to said buffer when a body of water contacts said water activated switch;

a transmitting unit including an encoder operable to provide a transmission word in response to a first portion of said second electrical power, and a transmitter operable to provide a transmission signal in response to said transmission word and a second portion of said second electrical power; and a receiving unit including a receiver operable to provide said transmission word in response to said transmission signal, and a decoder operable to provide a detection signal, said detection signal being in a first logic state in an absence of said transmission word and said detection signal being in a second logic state in response to said transmission word, and wherein said encoder includes a first oscillator input pin, a second oscillator input pin, and a resistor electrically coupled to said first oscillator input pin and said second oscillator input pin to thereby establish a transmission rate for said transmission word.

6. A water alert system comprising:

a power source operable to provide a first electrical power;

a buffering circuit including a buffer operable to provide a second electrical power in response to a first portion of said first electrical power, and a water activated switch operable to conduct said first portion of said first electrical power to said buffer when a body of water contacts said water activated switch;

a transmitting unit including an encoder operable to provide a transmission word in response to a first portion of said second electrical power, and a transmitter operable to provide a transmission signal in response to said transmission word and a second portion of said second electrical power; and a receiving unit including a receiver operable to provide said transmission word in response to said transmission signal, and a decoder operable to provide a detection signal, said detection signal being in a first logic state in an absence of said transmission word and said detection signal being in a second logic state in response to said transmission word, and wherein said decoder includes a first oscillator input pin, a second oscillator input pin, and a resistor electrically coupled to said first oscillator input pin and said second oscillator input pin to thereby establish a transmission rate for said transmission word.

7. A water alert system comprising:

a power source operable to provide a first electrical power;

a buffering circuit including a buffer operable to provide a second electrical power in response to a first portion of said first electrical power, and a water activated switch operable to conduct said first portion of said first electrical power to said buffer when a body of water contacts said water activated switch;

a transmitting unit including an encoder operable to provide a transmission word in response to a first portion of said second electrical power, and a transmitter operable to provide a transmission signal in response to said transmission word and a second portion of said second electrical power;

a receiving unit including a receiver operable to provide said transmission word in response to said transmission signal, and a decoder operable to provide a detection signal, said detection signal being in a first logic state in an absence of said transmission word and said detection signal being in a second logic state in response to said transmission word, a bistate device, wherein said bistate device is in a first state in response to said detection signal being in said first logic state and said bistate device is in a second state in response to said detection signal being in said second logic state, a transistor electrically coupled to said bistate device; and a resistor electrically coupled to said transistor and said decoder.

8. A water alert system comprising:

a power source operable to provide a first electrical power;

a buffering circuit including a buffer operable to provide a second electrical power in response to a first portion of said first electrical power, and a water activated switch operable to conduct said first portion of said first electrical power to said buffer when a body of water contacts said water activated switch;

a transmitting unit including an encoder operable to provide a transmission word in response to a first portion of said second electrical power, and a transmitter operable to provide a transmission signal in response to said transmission word and a second portion of said second electrical power;

a receiving unit including a receiver operable to provide said transmission word in response to said transmission signal, and a decoder operable to provide a detection signal, said detection signal being in a first logic state in an absence of said transmission word and said detection signal being in a second logic state in response to said transmission word, and a control device operable to provide a control signal wherein said control signal is in a third logic state in response to said detection signal being in said first logic state and said control signal is in a fourth logic state in response to said detection signal being in said second logic state, a transistor electrically coupled to said control device; and a resistor electrically coupled to said transistor and said decoder.

* * * * *

UNITED STATES PATENT AND TRADEMARK OFFICE

CERTIFICATE OF CORRECTION

PATENT NO. : 6,232,883 B1
DATED : May 15, 2001
INVENTOR(S) : Kevin DeVere Silva and Steven Dale McQueary It is certified that error appears in the above-identified patent and that said Letters Patent is hereby corrected as shown below:

Column 5,
Line 1, please change "B1," to -- B1 --.
Line 38, after the word "buffer" add -- , --.

Column 8,
Line 19, please delete the letter "t".
Lines 26, and 28, please change "310" to -- 30 --.

Column 13,
Line 10, please change "$VS_3$," to -- $VS_{S3}$, --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*